US011131497B2

(12) United States Patent
Trnka et al.

(10) Patent No.: US 11,131,497 B2
(45) Date of Patent: Sep. 28, 2021

(54) METHOD AND SYSTEM FOR CONTROLLING THE DEFROST CYCLE OF A VAPOR COMPRESSION SYSTEM FOR INCREASED ENERGY EFFICIENCY

(71) Applicant: Honeywell International Inc., Morris Plains, NJ (US)

(72) Inventors: Pavel Trnka, Prague (CZ); Jan Prasek, Susice (CZ)

(73) Assignee: Honeywell International Inc., Charlotte, NC (US)

( * ) Notice: Subject to any disclaimer, the term of this patent is extended or adjusted under 35 U.S.C. 154(b) by 281 days.

(21) Appl. No.: 16/445,012

(22) Filed: Jun. 18, 2019

(65) Prior Publication Data

US 2020/0400366 A1 Dec. 24, 2020

(51) Int. Cl.

| | |
|---|---|
| ***F25D 21/02*** | (2006.01) |
| ***F25B 49/02*** | (2006.01) |
| ***F25D 21/00*** | (2006.01) |

(52) U.S. Cl.

CPC ..... *F25D 21/02* (2013.01); *F25B 49/02* (2013.01); *F25D 21/006* (2013.01); *F25D 2700/00* (2013.01)

(58) Field of Classification Search

CPC .... F25D 21/02; F25D 21/006; F25D 2700/00; F25D 2347/02; F25D 2700/171

See application file for complete search history.

(56) References Cited

U.S. PATENT DOCUMENTS

| | | | | |
|---|---|---|---|---|
| 5,319,943 | A * | 6/1994 | Bahel | F25B 47/025 62/156 |
| 5,440,893 | A | 8/1995 | Davis et al. | |
| 5,488,218 | A * | 1/1996 | Olsen | G05D 23/1951 219/492 |
| 5,493,867 | A | 2/1996 | Szynal et al. | |
| 5,816,054 | A | 10/1998 | Yoo et al. | |
| 5,845,502 | A * | 12/1998 | Chen | F25B 47/025 62/81 |
| 6,138,464 | A | 10/2000 | Derosier et al. | |
| 6,148,623 | A | 11/2000 | Park et al. | |
| 6,668,566 | B2 | 12/2003 | Brun et al. | |
| 6,892,546 | B2 | 5/2005 | Singh et al. | |
| 7,921,660 | B2 | 4/2011 | Brody | |
| 8,590,326 | B2 * | 11/2013 | Yakumaru | F25B 47/022 62/156 |
| 9,068,771 | B2 | 6/2015 | Shah | |
| 9,188,381 | B2 | 11/2015 | Derosier | |

(Continued)

*Primary Examiner* — Kun Kai Ma

(74) *Attorney, Agent, or Firm* — Seager, Tufte & Wickhem, LLP

(57) ABSTRACT

Operating a vapor compression system including determining a total heat delivered by the vapor compression system, determining a total electrical energy consumed by the vapor compression system while delivering heat, maintaining a total electrical energy consumed by the vapor compression system during a defrosting cycle, determining a cumulative coefficient of performance of the vapor compression system based on the total heat delivered, the total electrical energy consumed by the vapor compression system while delivering heat, and the total electrical energy consumed by the vapor compression system during the defrosting cycle, and initiating a defrosting cycle based the cumulative coefficient of performance.

20 Claims, 8 Drawing Sheets

(56) References Cited

U.S. PATENT DOCUMENTS

| | | | | |
|---|---|---|---|---|
| 10,113,790 | B2 | 10/2018 | Seo | |
| 10,222,115 | B2 * | 3/2019 | Hamada | F25D 21/14 |
| 10,240,861 | B2 * | 3/2019 | Sugar | G08B 21/182 |
| 10,833,617 | B2 * | 11/2020 | Nakase | H02P 27/085 |
| 2002/0088238 | A1 * | 7/2002 | Holmes | F25D 21/006 62/155 |
| 2003/0084672 | A1 | 5/2003 | Pham et al. | |
| 2006/0230770 | A1 * | 10/2006 | Kitsch | F25B 13/00 62/151 |
| 2010/0071384 | A1 * | 3/2010 | Lu | F25B 7/00 62/3.2 |
| 2013/0219943 | A1 * | 8/2013 | Song | F28F 27/02 62/324.6 |
| 2013/0291577 | A1 * | 11/2013 | Miyakoshi | B60H 1/00785 62/151 |
| 2015/0007591 | A1 * | 1/2015 | Liu | F25B 49/005 62/77 |
| 2015/0314668 | A1 * | 11/2015 | Suzuki | F25B 5/02 62/160 |
| 2017/0276413 | A1 * | 9/2017 | Takeichi | F25B 49/022 |
| 2017/0276422 | A1 * | 9/2017 | Chamoun | F25B 30/02 |
| 2018/0051921 | A1 * | 2/2018 | Ho | F25B 49/02 |
| 2019/0310004 | A1 * | 10/2019 | Gries | F24F 11/37 |

* cited by examiner

Power Consumption:

310

30 rps — Input (W)

| Condensing Temperature (°C) \ Evaporating Temperature (°C) | -25.00 | -20.00 | -15.00 | -10.00 | -5.00 | 0.00 | 5.00 | 10.00 |
|---|---|---|---|---|---|---|---|---|
| 40.00 | 843.00 | 919.00 | 978.00 | 1020.00 | 1044.00 | 1050.00 | 1039.00 | 1011.00 |
| 50.00 | 992.00 | 1088.00 | 1167.00 | 1232.00 | 1280.00 | 1313.00 | 1330.00 | 1332.00 |
| 60.00 | 1146.00 | 1273.00 | 1385.00 | 1480.00 | 1559.00 | 1622.00 | 1668.00 | 1669.00 |

60 rps — Input (W)

| Condensing Temperature (°C) \ Evaporating Temperature (°C) | -25.00 | -20.00 | -15.00 | -10.00 | -5.00 | 0.00 | 5.00 | 10.00 |
|---|---|---|---|---|---|---|---|---|
| 40.00 | 1843.00 | 1955.00 | 2054.00 | 2130.00 | 2184.00 | 2215.00 | 2223.00 | 2208.00 |
| 50.00 | 2123.00 | 2275.00 | 2410.00 | 2526.00 | 2624.00 | 2703.00 | 2764.00 | 2806.00 |
| 60.00 | 2443.00 | 2638.00 | 2816.00 | 2977.00 | 3120.00 | 3254.00 | 3354.00 | 3445.00 |

90 rps — Input (W)

| Condensing Temperature (°C) \ Evaporating Temperature (°C) | -25.00 | -20.00 | -15.00 | -10.00 | -5.00 | 0.00 | 5.00 | 10.00 |
|---|---|---|---|---|---|---|---|---|
| 40.00 | 2997.00 | 3207.00 | 3389.00 | 3543.00 | 3668.00 | 3765.00 | 3833.00 | 3873.00 |
| 50.00 | 3446.00 | 3696.00 | 3925.00 | 4132.00 | 4318.00 | 4483.00 | 4626.00 | 4748.00 |
| 60.00 | 3990.00 | 4289.00 | 4571.00 | 4836.00 | 5084.00 | 5315.00 | 5529.00 | 5726.00 |

FIG. 3B

Refrigerant Mass Flow:

406

30 rps

| Flow Rate (kg/h) / Condensing Temperature (°C) | Evaporating Temperature (°C) | | | | | | | |
|---|---|---|---|---|---|---|---|---|
| | -25.00 | -20.00 | -15.00 | -10.00 | -5.00 | 0.00 | 5.00 | 10.00 |
| 40.00 | 32.90 | 40.30 | 49.70 | 60.90 | 74.00 | 88.90 | 106.70 | 124.40 |
| 50.00 | 31.50 | 38.00 | 46.50 | 57.20 | 69.90 | 84.80 | 101.70 | 120.70 |
| 60.00 | 29.90 | 35.70 | 43.70 | 53.80 | 66.10 | 80.60 | 97.10 | 115.80 |

60 rps

| Flow Rate (kg/h) / Condensing Temperature (°C) | Evaporating Temperature (°C) | | | | | | | |
|---|---|---|---|---|---|---|---|---|
| | -25.00 | -20.00 | -15.00 | -10.00 | -5.00 | 0.00 | 5.00 | 10.00 |
| 40.00 | 72.50 | 90.30 | 111.00 | 134.80 | 161.50 | 191.40 | 224.20 | 260.10 |
| 50.00 | 68.20 | 84.20 | 103.60 | 126.50 | 152.80 | 182.50 | 215.70 | 252.30 |
| 60.00 | 63.60 | 78.50 | 97.00 | 119.30 | 145.20 | 174.80 | 208.00 | 244.90 |

90 rps

| Flow Rate (kg/h) / Condensing Temperature (°C) | Evaporating Temperature (°C) | | | | | | | |
|---|---|---|---|---|---|---|---|---|
| | -25.00 | -20.00 | -15.00 | -10.00 | -5.00 | 0.00 | 5.00 | 10.00 |
| 40.00 | 115.80 | 141.20 | 171.90 | 207.70 | 248.70 | 294.90 | 240.30 | 402.90 |
| 50.00 | 110.20 | 135.20 | 165.50 | 201.10 | 242.10 | 288.30 | 339.80 | 396.60 |
| 60.00 | 104.90 | 129.70 | 159.80 | 195.30 | 236.10 | 283.20 | 333.70 | 390.50 |

FIG. 4B

METHOD AND SYSTEM FOR CONTROLLING THE DEFROST CYCLE OF A VAPOR COMPRESSION SYSTEM FOR INCREASED ENERGY EFFICIENCY

TECHNICAL FIELD

The disclosure relates generally to vapor compression systems, and more particularly, to methods and systems for controlling the defrost cycle of vapor compression systems for increased energy efficiency.

BACKGROUND

Vapor compression systems are often used to provide heating and/or cooling to a controlled space. Example vapor compression systems include heat pumps and air-conditioners that provide heating and/or cooling to a building for increased occupant comfort, and refrigeration units that provide cold storage for goods in the home, grocery stores, warehouses and other applications. Many vapor compression systems use a compressor, a condenser, an evaporator and an expansion valve to transfer heat from one region to another. For example, during operation, a refrigerant pressurized by the compressor is cooled by a reduction in pressure through the expansion valve. The cooled refrigerant extracts heat via the evaporator at a cold region. The heated refrigerant is re-pressurized by the compressor and delivered to the condenser. The condenser releases the heat to a hot region. This process is repeated to transfer heat from the cold region to the hot region.

When the cold region reaches a low ambient temperature, the surface temperature of the evaporator can fall below the dew point of air and below the freezing point of water, which can result in water vapor in the air condensing on the outside of the evaporator and form a layer of ice. The layer of ice acts as thermal insulation on the evaporator and gradually reduces the efficiency of the evaporator and thus the vapor compression system. Because of this known phenomenon, the ice is typically periodically eliminated by reversing the vapor compression system for a short time, during what is referred to as a defrost cycle, which heats the evaporator and melts the ice. The defrost cycles not only consumes significant electrical energy, but they also reverse the intended heating or cooling of the vapor compression system. Defrosting too early can waste energy by unnecessarily heating an evaporator that is still operating relatively efficiently, and defrosting too late can waste energy by operating the vapor compression system with a heavily iced up evaporator.

In many vapor compression systems, defrosting cycles are controlled to occur at regular fixed time intervals or at an interval that does not take in account current operating condition. What would be desirable is a method and system to control the defrost cycles of a vapor compression system in a manner that takes in account current operating conditions so as to increase the overall energy efficiency of the vapor compression system.

SUMMARY

This disclosure relates generally to vapor compression system, and more particularly, to methods and systems for controlling the defrost cycle of vapor compression systems. In one example, a method of operating a vapor compression system includes determining a measure related to a total heat delivered (THD) by the vapor compression system following a completion of a defrosting cycle, determining a measure related to a total electrical energy consumed (TEC-H) by the vapor compression system while delivering heat following completion of the defrosting cycle, maintaining a measure related to a total electrical energy consumed (TEC-D) by the vapor compression system during a previous defrosting cycle, determining a cumulative coefficient of performance (CCOP) of the vapor compression system based at least in part on the measure related to a total heat delivered (THD) by the vapor compression system following the completion of a defrosting cycle, the measure related to a total electrical energy consumed (TEC-H) by the vapor compression system while delivering heat following the completion of the defrosting cycle, and the measure related to a total electrical energy consumed (TEC-D) by the vapor compression system during the defrosting cycle, and initiating a next defrosting cycle at a time that is based at least in part on one or more characteristics of the cumulative coefficient of performance (CCOP).

Alternatively or additionally to the foregoing, the vapor compression system may include a compressor, a condenser, an evaporator and an expansion valve. In some cases, the compressor and the evaporator may circulate a refrigerant.

Alternatively or additionally to any of the embodiments above, determining the measure related to the total heat delivered (THD) by the vapor compression system following the completion of the defrosting cycle may include determining a speed of the compressor, sensing a discharge pressure of the refrigerant at an output of the compressor, and using the discharge pressure to identify a condensing temperature of the refrigerant, sensing a suction pressure of the refrigerant at an input of the compressor, and using the suction pressure to identify an evaporating temperature of the refrigerant, and determining the measure related to the total heat delivered (THD) by the vapor compression system based at least in part on the speed of the compressor, the condensing temperature and the evaporating temperature.

Alternatively or additionally to any of the embodiments above, further including sensing a discharge temperature of the refrigerant at the output the compressor, and wherein the measure related to the total heat delivered (THD) by the vapor compression system may be based at least in part on the speed of the compressor, the condensing temperature, the evaporating temperature and the discharge temperature.

Alternatively or additionally to any of the embodiments above, further including sensing the discharge pressure and the suction pressure using respective pressure sensors.

Alternatively or additionally to any of the embodiments above, the CCOP may be determined by dividing the measure related to a total heat delivered (THD) by the sum of the measure related to the total electrical energy consumed (TEC-H) by the vapor compression system while delivering heat plus the measure related to the total electrical energy consumed (TEC-D) by the vapor compression system during the defrosting cycle.

Alternatively or additionally to any of the embodiments above, the measure related to the total electrical energy consumed (TEC-D) by the vapor compression system during the defrosting cycle may be an average of the total electrical energy consumed (TEC-D) by the vapor compression system during a previous "N" of the defrosting cycle, wherein "N" is an integer greater than or equal to 1.

Alternatively or additionally to any of the embodiments above, the next defrosting cycle may be initiated at a time when the cumulative coefficient of performance (CCOP) reaches a maximum (e.g. peak) value.

Alternatively or additionally to any of the embodiments above, the next defrosting cycle may be initiated at a time when a derivative of the cumulative coefficient of performance (CCOP) crosses zero.

Alternatively or additionally to any of the embodiments above, the vapor compression system may include a heat pump system configured to heat a building.

Alternatively or additionally to any of the embodiments above, the vapor compression system may include a refrigeration system.

In another example, a vapor compression system may include a compressor configured to pressurize a refrigerant, a condenser operatively coupled to the compressor and configured to receive the compressed refrigerant from the compressor, an evaporator operatively coupled to the compressor and configured to return expanded refrigerant to the compressor, an expansion valve operatively coupled between the evaporator and the condenser and configured to expand the compressed refrigerant, and a controller operatively coupled to the compressor. The controller may be configured to record a heat delivered by the refrigerant and an operational energy of the compressor during an operational period of the vapor compression system, determine a cumulative coefficient of performance (CCOP) of the system based on the recorded delivered heat, the recorded operational energy, and a defrost energy consumed by the compressor during a previous defrost period of the vapor compression system, and initiate a next defrost period of the vapor compression system in response to the CCOP of the system meeting one or more predefined conditions.

Alternatively or additionally to any of the embodiments above, further including a set of sensors operatively coupled to the controller, the set of sensors may be configured to sense a discharge pressure of the refrigerant at an output of the compressor and a suction pressure of the refrigerant at an input of the compressor, wherein the discharge pressure may be used to identify a condensing temperature of the refrigerant and the suction pressure is used to identify an evaporating temperature of the refrigerant.

Alternatively or additionally to any of the embodiments above, the recorded heat delivered by the refrigerant and the operational energy of the compressor may be based at least in part on the condensing temperature of the refrigerant, the evaporating temperature of the refrigerant, and a speed of the compressor.

Alternatively or additionally to any of the embodiments above, the CCOP may be determined by dividing the recorded delivered heat by the sum of the recorded operational energy plus the defrost energy consumed by the compressor during the previous defrost period of the vapor compression system.

Alternatively or additionally to any of the embodiments above, the next defrost period may be initiated at a time when the CCOP reaches a maximum value.

In another example, a non-transient computer readable medium may including instructions stored thereon that when executed by a processor cause the processor to receive one or more sensed conditions of a vapor compression system, using one or more of the sensed conditions to determine a measure related to a total heat delivered (THD) by the vapor compression system following a completion of a defrosting cycle, using one or more of the sensed conditions to determine a measure related to a total electrical energy consumed (TEC-H) by the vapor compression system while delivering heat following the completion of the defrosting cycle, store a measure related to a total electrical energy consumed (TEC-D) by the vapor compression system during a previous defrosting cycle, determining a cumulative coefficient of performance (CCOP) of the vapor compression system based at least in part on the measure related to a total heat delivered (THD) by the vapor compression system following the completion of a defrosting cycle, the measure related to a total electrical energy consumed (TEC-H) by the vapor compression system while delivering heat following the completion of the defrosting cycle, and the measure related to a total electrical energy consumed (TEC-D) by the vapor compression system during the defrosting cycle, and initiating a next defrosting cycle of the vapor compression system at a time that is based at least in part on one or more characteristics of the cumulative coefficient of performance (CCOP).

Alternatively or additionally to any of the embodiments above, the next defrosting cycle may be initiated at a time when the cumulative coefficient of performance (CCOP) reaches a maximum value.

Alternatively or additionally to any of the embodiments above, the vapor compression system may include a compressor and an evaporator circulating a refrigerant. Additionally, determining the measure related to the total heat delivered (THD) by the vapor compression system following the completion of the defrosting cycle may include determining a speed of the compressor, sensing a discharge pressure of the refrigerant at an output of the compressor, and using the discharge pressure to identify a condensing temperature of the refrigerant, sensing a suction pressure of the refrigerant at an input of the compressor, and using the suction pressure to identify an evaporating temperature of the refrigerant, and determining the measure related to the total heat delivered (THD) by the vapor compression system based at least in part on the speed of the compressor, the condensing temperature and the evaporating temperature.

Alternatively or additionally to any of the embodiments above, further including sensing a discharge temperature of the refrigerant at the output the compressor, and wherein the measure related to the total heat delivered (THD) by the vapor compression system may be based at least in part on the speed of the compressor, the condensing temperature, the evaporating temperature and the discharge temperature.

The above summary of some illustrative embodiments is not intended to describe each disclosed embodiment or every implementation of the present disclosure. The Figures and Description which follow more particularly exemplify these and other illustrative embodiments.

BRIEF DESCRIPTION OF THE FIGURES

The disclosure may be more completely understood in consideration of the following description in connection with the accompanying drawings, in which:

FIG. 3B depicts an example of a compressor power consumption look-up table;

FIG. 4B depicts an example of a refrigerant mass flow look-up table;

Figure 1:
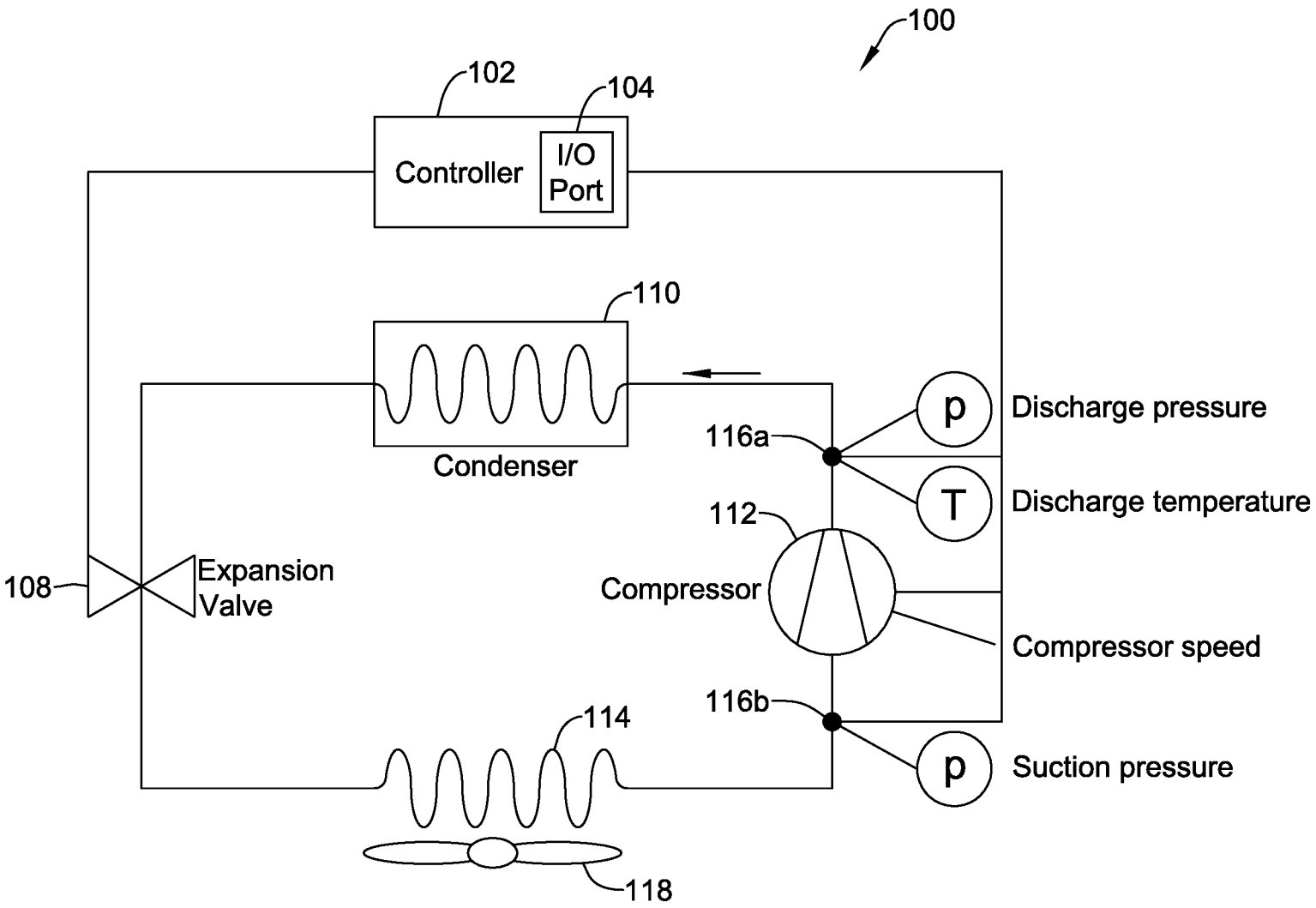
FIG. 1 is a schematic view of an illustrative vapor compression system.

While the disclosure is amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DESCRIPTION

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

The recitation of numerical ranges by endpoints includes all numbers within that range (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

It is noted that references in the specification to "an embodiment", "some embodiments", "other embodiments", etc., indicate that the embodiment described may include one or more particular features, structures, and/or characteristics. However, such recitations do not necessarily mean that all embodiments include the particular features, structures, and/or characteristics. Additionally, when particular features, structures, and/or characteristics are described in connection with one embodiment, it should be understood that such features, structures, and/or characteristics may also be used connection with other embodiments whether or not explicitly described unless clearly stated to the contrary.

The following description should be read with reference to the drawings in which similar structures in different drawings are numbered the same. The drawings, which are not necessarily to scale, depict illustrative embodiments and are not intended to limit the scope of the disclosure. Although examples of construction, dimensions, and materials may be illustrated for the various elements, those skilled in the art will recognize that many of the examples provided have suitable alternatives that may be utilized.

The current disclosure relates to devices, controllers, systems, computer programs, and methods adapted to initiate a defrosting cycle for a vapor compression system. In some instances, the time at which the defrosting cycle is initiated may be an optimal time with respect to the overall cost of operating the vapor compression system, taking into account both the electricity consumed by the vapor compression system to deliver temperature controlled air and the electricity consumed by the vapor compression system to perform a defrost cycle. For instance, in some cases, the total heat delivered (THD) by the vapor compression system, the total electrical energy consumed (TEC-H) by the vapor compression to deliver heat, and the total electrical energy consumed (TEC-D) by the vapor compression during a defrosting cycle may be determined. The THD, the TEC-H, and the TEC-D may then be used to determine a cumulative coefficient of performance (CCOP) of the vapor compression system that may indicate an optimal or desired time to initiate a defrosting cycle for the vapor compression system.

FIG. 1 is a schematic view of an illustrative vapor compression system 100 with a controller 102. The controller 102 may include an I/O port 104 that communicates using a communication protocol. In some cases, the communication protocol may be an industry standard communication protocol such as BACNET, LONWORKS or Ethernet, for example, and in other cases it may be a proprietary communication protocol unique to the manufacturer of the controller 102 and/or components of vapor compression system 100. The I/O port 104 of the controller 102 facilitates access to, control of, and/or external communication to/from the vapor compression system 100. The controller 102 may be used to control the vapor compression system 100. The controller 102 can be integrated into the vapor compression system 100, or may be separate from the vapor compression system 100 and communicate with the vapor compression system 100 via a wired or wireless interface. In some cases, the controller 102

In some cases, the illustrative vapor compression system 100 may include a liquid refrigerant that circulates through the vapor compression system 100. In some instances, the vapor compression system 100 may include an expansion valve 108, a condenser 110, a compressor 112, an evaporator 114, and a number of sensors 116*a*-116*b*. The controller 102 may be configured to receive sensed signals from the sensors 116*a*-116*b*, and control the operation of the compressor 112, the expansion valve 108 and/or other components of the vapor compression system 100 as desired. In some cases, the illustrative vapor compression system 100 may provide heating and/or cooling to a building for increased occupant comfort, such as a house, a retail store(s) (e.g., a supermarket, grocery store, mall, etc.), an office building, a factory/plant, a school, etc. In other cases, the illustrative vapor compression system 100 may be part of a refrigeration unit that provide cold storage for goods in the home, grocery stores, warehouses and/or other applications.

It is noted that while one vapor compression system (e.g., vapor compression system 100) is shown in FIG. 1, embodiments of the present disclosure are applicable to a plurality of vapor compression systems. In some cases, each vapor compression system may be controlled by a corresponding controller 102 designated specifically for that vapor compression system. However, this is not required. In some instances, a single local controller (e.g., the controller 102) may be used to control several vapor compression systems. Moreover, some vapor compression systems may include a single compressor that provides compressed refrigerant to multiple refrigerant circuits. In another example, a vapor compression system may include a rack of compressors that supply compressed refrigerant to each of two or more independently controlled circuits of the vapor compression system. In some cases, a single local controller may control such a vapor compression system 100. In other cases, multiple controllers may control such a vapor compression system.

In some examples, during an operational period, the refrigerant flows (e.g., circulates) through the illustrative vapor compression system 100 of FIG. 1 in a counterclockwise direction. That is, the refrigerant pressurized by the compressor 112 is cooled by a reduction in pressure through the expansion valve 108. The cooled refrigerant extracts heat from air via the evaporator 114 at a cooler region, sometimes with the aid of fan 118. The heated refrigerant is re-pressurized by the compressor 112 and delivered to the condenser 110. The condenser 110 releases the heat at a hotter region. This process is repeated to transfer heat from the cooler region to the hotter region.

In some examples, the compressor 112 may be a fixed speed compressor. In other examples, the compressor 112 may be a variable-speed or modulating compressor. In some instances, the controller 102 may determine the speed, in real time, at which the compressor 112 operates to compress the refrigerant. The controller 102 may record the TEC-H or the operational energy consumed by the compressor 112 during the operational period.

In some cases, sensors 116*a*-116*b* may be used to sense parameters, measurements, points, and/or other properties of the refrigerant, the vapor compression system 100, and/or components of the vapor compression system 100. In some instances, the vapor compression system 100 may include more or fewer sensors. In some examples, the sensors 116*a*-116*b* can detect the measurements in real time. In some cases, the sensors 116*a*-116*b* may include, but are not limited to, pressure sensors, temperature sensors, flow-rate sensors, position sensors, composition sensors, chemical sensors, alarm sensors, etc.

In one particular example, the sensor 116*a* may include a pressure sensor that can sense a discharge pressure of the refrigerant at the output of the compressor 112. In some instances, the controller 102 can receive the sensed discharge pressure and identify a condensing temperature of the refrigerant using the discharge pressure. The sensor 116*a* may include a temperature sensor that can sense a discharge temperature of the refrigerant at the output of the compressor 112. The controller 102 may adjust the speed of the compressor 112 as needed to increase or decrease the pressure and/or temperature on the refrigerant at the output of the compressor 112.

After exiting the compressor 112, the hot compressed refrigerant flows (e.g., be routed) to the condenser 110. The condenser 110 condenses the refrigerant (e.g., superheated) vapor into a liquid. In some cases, the condenser 110 can include a coil or tubes, and the condenser 110 can condense the refrigerant vapor into a liquid by flowing the refrigerant through the coil or tubes while flowing cool water or cool air across the coil or tubes, such that heat from the refrigerant is carried away by the water or air. The condensed liquid refrigerant then flows to the expansion valve 108. The expansion valve 108 can be configured to adjust the pressure of the condensed liquid refrigerant downstream of the expansion valve 108. The pressurized refrigerant is cooled by a reduction in pressure through the expansion valve 108. In the example shown, the expansion valve 108 is controlled by controller 102 via a direct connection or a wired or wireless network(s) to decrease the pressure of the sub-cooled liquid refrigerant output from the condenser 110. After flowing through the expansion valve 108, the refrigerant enters coil or tubes of the evaporator 114. A fan 118 may pass air from colder region across the coil or tubes carrying the refrigerant, which cools the air (i.e. extracts heat from the air) and thus lowers the temperature of the air. This may evaporate the refrigerant so that the refrigerant is once again a saturated vapor. The saturated vapor exits evaporator 114 and flow to the compressor 112, and the cycle is repeated to transfer heat from the colder region to the hotter region.

In some cases, the sensor 116*b* may include a pressure sensor that can sense a suction pressure of the saturated refrigerant vapor after it exits the evaporator 114 and is input back into the compressor 112. In some instances, the controller 102 can receive the sensed suction pressure and identify an evaporating temperature of the refrigerant using the suction pressure. In some examples, the controller 102 may determine and record a measure related to the THD by the vapor compression system based on the speed of the compressor, the condensing temperature of the refrigerant at the output of the compressor 112, the evaporating temperature of the refrigerant at the input of the compressor 112, and the discharge temperature of the refrigerant at the output of the compressor 112. Moreover, in some examples, the controller 102 may adjust the speed of the compressor 112 as needed to increase or decrease the pressure and/or temperature of the refrigerant by a controlled amount at the output of the compressor 112 based on the sensed suction pressure.

In many cases, vapor compression systems, such as the vapor compression system 100, must deal with frosting. At low ambient temperature conditions, the surface temperature of the evaporator 114 can fall below the dew point of humid air and below the freezing point of water, resulting in the water vapor contained in the air being deposited on the evaporator 114 in the form of ice. In this instance, the controller 102 may place the vapor compression system 100 in a defrost cycle or period. In one example, during the defrost cycle, the refrigerant can again flow through the vapor compression system 100 in a counterclockwise direction. During this time, the TEC-D or defrost energy is used by the compressor 112 to compress the vapor refrigerant into a higher pressure vapor. However, in this instance, the hotter, compressed refrigerant vapor can flow directly to the evaporator 114 to help melt the ice that has built up on the evaporator 114. To shorten the duration of the defrost cycle, in some cases, the fan 118 may be turned off to decrease the air flow across the evaporator 114 and thus decrease the amount of heat extracted heat from the hot compressed refrigerant vapor that would have otherwise been used to defrost the evaporator 114. Once the ice has been sufficiently removed from the evaporator 114, the controller 102 may place the vapor compression system 100 back in an operational period.

In some cases, the controller 102 may use the THD, the TEC-H, and the TEC-D to determine an efficiency of performance of the vapor compression system 100. In some instances, the controller 102 may initiate a defrost cycle for the vapor compression system in response to the determined efficiency of performance meeting one or more predefined conditions or thresholds. For example, an optimal time for the vapor compression system 100 to enter a defrost cycle, given the current operating conditions, may be when the vapor compression system 100 has reached a maximum cumulative operating efficiency. In some examples, the cumulative operating efficiency of the vapor compression system 100 may be represented as a Cumulative Coefficient Of Performance (CCOP) given by:

$$CCOP=THD/(TEC\text{-}H+TEC\text{-}D) \quad \text{Equation (1)}$$

In this example, when the CCOP reaches a maximum, that is, when the derivative of the CCOP crosses zero, the controller 102 may determine that the vapor compression system 100 has reached the optimal time to initiate a defrost cycle for the evaporator 114.

Figure 2:
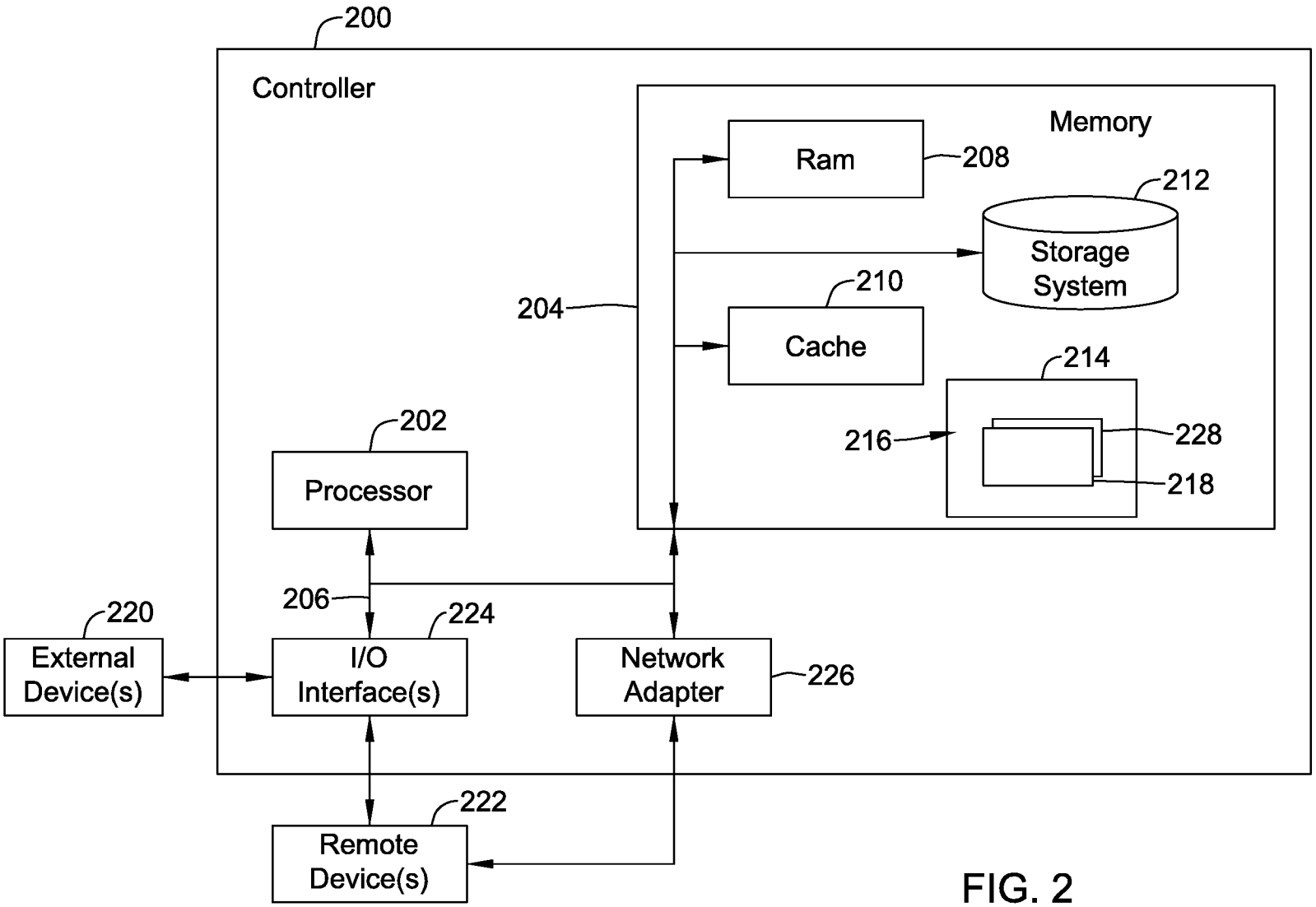
FIG. 2 is a schematic view of an illustrative computing device suitable for controlling a vapor compression system.

FIG. 2 depicts a schematic of an illustrative controller device 200. The controller device 200 is only one example of a suitable computing device and is not intended to suggest any limitation as to the scope of use or functionality of embodiments described herein. Regardless, it is contemplated that the controller device 200 is capable of being implemented and/or performing any of the functionality set forth herein.

The illustrative controller device 200 may be configured to control a vapor compression system (e.g., vapor compression system 100 of FIG. 1). In some cases, the controller device 200 may be implemented using a general purpose and/or special purpose computing environment. In some cases, the controller 200 may be local to the vapor compression system 100, while in other cases the controller 200 may be remote from the vapor compression system 100. In some cases, part of the controller 200 is local to the vapor compression system 100, and part of the controller 200 may be remote (e.g. in the cloud). These are just examples.

The controller device 200 may be described in the general context of computer system executable instructions, such as program modules, being executed by a computing device. Generally, program modules may include routines, programs, objects, components, logic, data structures, and so on that perform particular tasks or implement particular data manipulation functions. In some cases, the controller device 200 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 2, the illustrative controller device 200 may include, but are not limited to, one or more processors 202, a system memory 204, and a bus 206 that couples various system components including system memory 204 to the processor 202.

The bus 206 may represent one or more of any of several types of bus structures, including a memory bus or memory controller, a peripheral bus, an accelerated graphics port, and a processor or local bus using any of a variety of bus architectures. By way of example, and not limitation, such architectures may include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus. In some cases, the bus may be implemented using a proprietary bus architecture.

In some instances, the processor 202 may include a pre-programmed chip, such as a very-large-scale integration (VLSI) chip and/or an application specific integrated circuit (ASIC). In such embodiments, the chip may be pre-programmed with control logic in order to control the operation of the controller device 200. In some cases, the pre-programmed chip may implement a state machine that performs the desired functions. By using a pre-programmed chip, the processor 202 may use less power than other programmable circuits (e.g. general purpose programmable microprocessors) while still being able to maintain basic functionality. In other instances, the processor 202 may be a programmable microprocessor. Such a programmable microprocessor may allow a user to modify the control logic of the controller device 200 even after it is installed in the field (e.g. firmware/software updates), which may allow for greater flexibility of the controller device 200 in the field over using a pre-programmed ASIC.

The controller device 200 may include a variety of computer system readable media. Such media may be any available media that is accessible by the controller device 200, and may include volatile and/or non-volatile media, removable and non-removable media.

The illustrative controller device 200 may include computer system readable media in the form of volatile memory, such as random access memory (RAM) 208 and/or cache memory 210. The controller device 200 may further include other removable/non-removable, volatile/non-volatile computer system storage media. By way of example only, storage system 212 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM, EPROM, flash memory (e.g., NAND flash memory), an external SPI flash memory or other optical media can be provided. In such instances, each can be connected to the bus 206 by one or more data media interfaces. As will be further depicted and described below, memory 204 may include at least one program product having a set (e.g., at least one) of program modules (e.g., software) that are configured to carry out the functions of embodiments of the disclosure.

Program/utility 214, having a set (e.g., at least one) of program modules 216, may be stored in memory 204 by way of example, and not limitation, as well as an operating system, one or more application programs (e.g., a vapor compression system control application 218, look up tables 228, etc.), and/or other program modules and program data. Each of the operating system, one or more application programs, other program modules and program data or some combination thereof, may include an implementation of a networking environment. Program modules 216 generally carry out the functions and/or methodologies of embodiments of the disclosure as described herein. In some cases, the program modules 216 and/or the application programs (e.g., vapor compression system control application 218 and the look up tables 228) may include assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages.

The controller device 200 may also communicate with one or more external devices 220 such as a keyboard, a pointing device, a display, etc.; one or more devices that facilitate a user in interacting with the controller device 200; and/or any devices (e.g., network card, modem, wireless network card, etc.) that facilitate the controller device 200 in communicating with one or more other remote device(s) 222 such as, for example, the vapor compression system 100, a field device, a smart phone, tablet computer, laptop computer, personal computer, PDA, and/or the like. Such communication with the external device 220 can occur via Input/Output (I/O) interfaces 224. Still yet, the controller device 200 can communicate with the external devices 220 and/or the remote devices 222 over one or more networks such as a local area network (LAN), a general wide area network (WAN), and/or a public network (e.g., the Internet)

via network adapter 226. As depicted, the I/O interfaces 224 and the network adapter 226 communicate with the other components of the controller device 200 via bus 206. In some cases, the remote devices 222 may provide a primary and/or a secondary user interface for the user to interact with the controller device 200. In some cases, the controller device 200 may utilize a wireless protocol to communicate with the remote devices 222 over a wireless network.

As stated above, in some cases, the remote device(s) 222 may include the vapor compression system 100 (shown in FIG. 1). In some examples, the processor 202 may control the vapor compression system 100 by receiving sensor and/or other data from the vapor compression system 100 and/or other external information (e.g. weather information, etc.), and sending input commands to vapor compression system 100. In some cases, a command may be an instruction, order, or directive and may include a high-level goal (e.g., initiating a defrosting cycle for the vapor compression system 100) that is sent to a local controller of the a vapor compression system 100, or one or more low-level instructions (e.g., increasing/decreasing the speed of the compressor 112, increasing/decreasing the speed of the fan 118, turning on/off the fan 118, etc.) that is sent to directly control the vapor compression system 100.

It is contemplated that the vapor compression system control application 218 may provide instructions to the processor 202 for initializing a defrost cycle for the vapor compression system 100. In some instances, the vapor compression system control application 218 and the look up tables 228 may execute entirely on the controller device 200, as a stand-alone software package, and/or partly on the controller device 200 and partly on the remote devices 222, such as for example, a location controller of the vapor compression system 100.

Figure 3A:
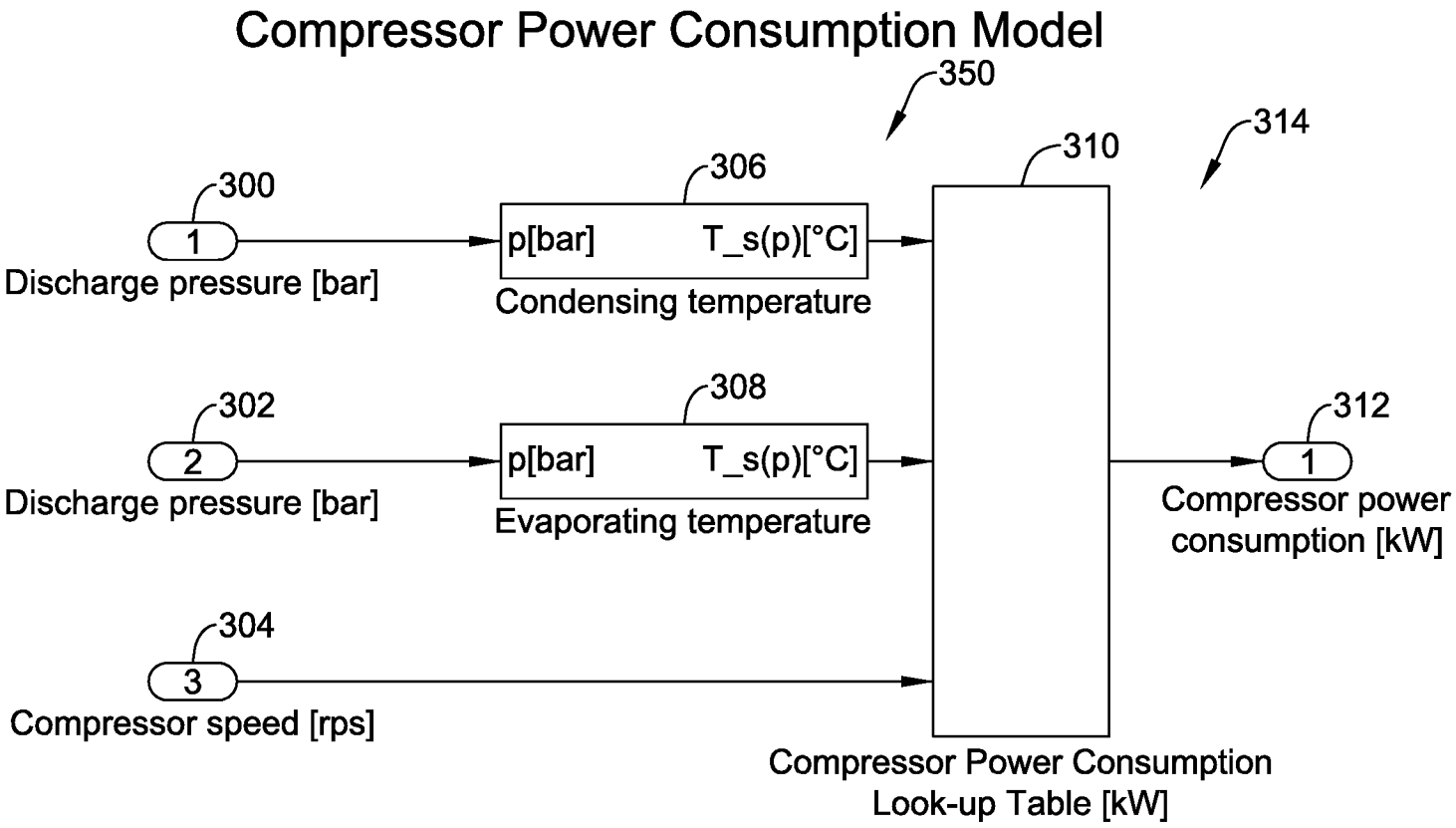
FIG. 3A is a flow chart showing an illustrative method for determining a measure related to the electrical energy consumed by the vapor compression system.

FIG. 3A is a flow chart showing an illustrative method 350 for determining a measure related to the electrical energy consumed by the vapor compression system 100 that may be implemented as part of the vapor compression system control application 218. As shown in FIG. 3A, in some cases, during an operational period of the vapor compression system 100, the vapor compression system control application 218 may provide instructions to the processor 202 to obtain signals from the sensors 116*a*-116*b* and the compressor 112 that indicate a discharge pressure 300 of a refrigerant from the compressor 112, a suction pressure 302 of the refrigerant to the compressor 112, and a speed of the compressor 112. In some instances, the processor 202 may use the discharge pressure 300 to determine/identify a condensing temperature 306 of the refrigerant and the suction pressure 302 to determine/identify an evaporating temperature 308 of the refrigerant. In some cases, the vapor compression system control application 218 may provide instructions to the processor 202 to access the look up tables 228 and reference a compressor power consumption look up table 310 that is specific to the particular compressor used in the vapor compression system 100. Moreover, the vapor compression system control application 218 may provide instructions to the processor 202 to use the condensing temperature 306, the evaporating temperature 308, and the compressor speed 304 as indexes to the compressor power consumption look up table 310 to identify an electrical energy consumed 312 by the vapor compression system 100/compressor 112.

FIG. 3B depicts an example of compressor power consumption look up table 310. As shown, the electrical energy consumed by the vapor compression system 100/compressor 112 may be dependent on the condensing temperature 306, the evaporating temperature 308, and the compressor speed 304. For example, when the compressor speed 304 is 30 rps, the condensing temperature 306 is 40° C., and the evaporating temperature 308 is −25° C., the electrical energy consumed 312 by the compressor 112 is 843 W. In another example, when the compressor speed 304 is 60 rps, the condensing temperature 306 is 50° C., and the evaporating temperature 308 is −10° C., the electrical energy consumed by the compressor 112 is 2526 W. In yet a further example, when the compressor speed 304 is 90 rps, the condensing temperature 306 is 60° C., and the evaporating temperature 308 is 10° C., the electrical energy consumed by the compressor is 5726 W.

Figure 4A:
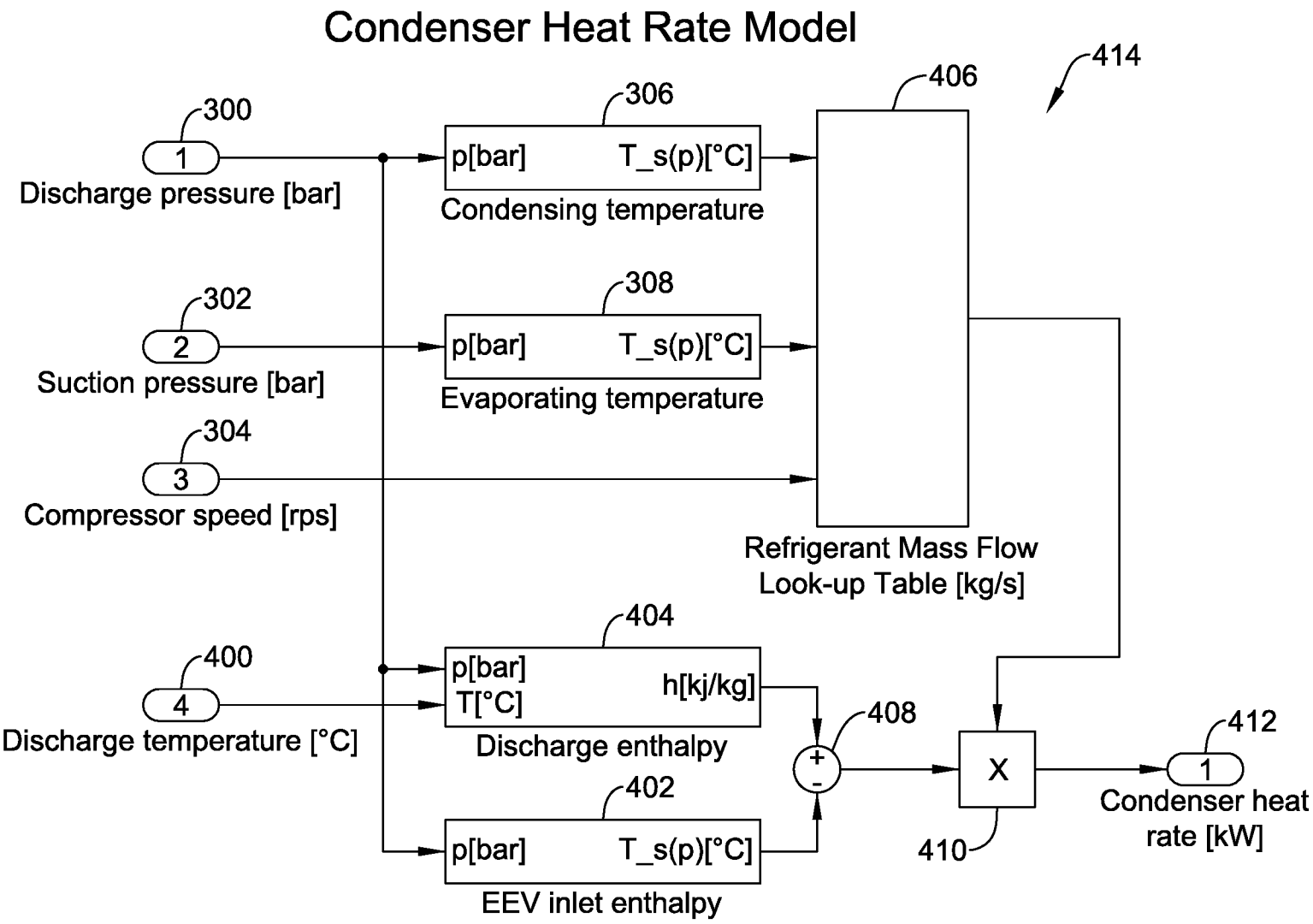
FIG. 4A is a flow chart showing an illustrative method for determining a measure related to a condenser heat rate of the vapor compression system.

Turning to FIG. 4A, the method 350 may also determining a measure related to a condenser heat rate of the vapor compression system 100. As shown in FIG. 4A, during the operational period of the vapor compression system 100, the processor 202 may obtain the discharge pressure 300 of the refrigerant, the suction pressure 302 of the refrigerant, and the speed of the compressor 112. The vapor compression system control application 218 may provide instructions to the processor 202 to obtain signals from the sensors 116*a*-116*b* and the compressor 112 that indicate a discharge temperature 400 of the refrigerant. The processor 202 may use the discharge pressure 300 to determine/identify the condensing temperature 306 of the refrigerant and an electrical expansion valve 108 (EEV) inlet enthalpy 402. The processor 202 may use the suction pressure 302 to determine/identify the evaporating temperature 308 of the refrigerant. The processor 202 may use the discharge temperature 400 and the discharge pressure 300 to determine/identify a discharge enthalpy 404 of the vapor compression system 100. In some cases, the vapor compression system control application 218 may provide instructions to the processor 202 to access the look up tables 228 and reference a refrigerant mass flow look up table 406. The vapor compression system control application 218 may provide instructions to the processor 202 to use the condensing temperature 306, the evaporating temperature 308, and the compressor speed 304 to identify, from the refrigerant mass flow look up table 406, a mass flow rate (e.g. kg/s) of the refrigerant.

FIG. 4B depicts an example of the refrigerant mass flow look up table 406. As shown, the mass flow rate of the refrigerant may be dependent on the condensing temperature 306, the evaporating temperature 308, and the compressor speed 304. For example, when the compressor speed 304 is 30 rps, the condensing temperature 306 is 40° C., and the evaporating temperature 308 is −25° C., the mass flow rate of the refrigerant is 32.90 kg/h. In another example, when the compressor speed 304 is 60 rps, the condensing temperature 306 is 50° C., and the evaporating temperature 308 is −10° C., the mass flow rate of the refrigerant is 126.50 kg/h. In yet a further example, when the compressor speed 304 is 90 rps, the condensing temperature 306 is 60° C., and the evaporating temperature 308 is 10° C., the mass flow rate of the refrigerant is 390.50 kg/h.

Turning back to FIG. 4A, in some cases, a difference block 408 calculates a difference of the discharge enthalpy 404 and the EEV inlet enthalpy 402. At multiplication block 410, the processor 202 may take the product of the mass flow rate of the refrigerant and the difference of the discharge enthalpy 404 and the EEV inlet enthalpy 402 to determine a condenser heat rate (e.g. kW) 412.

Figure 5:
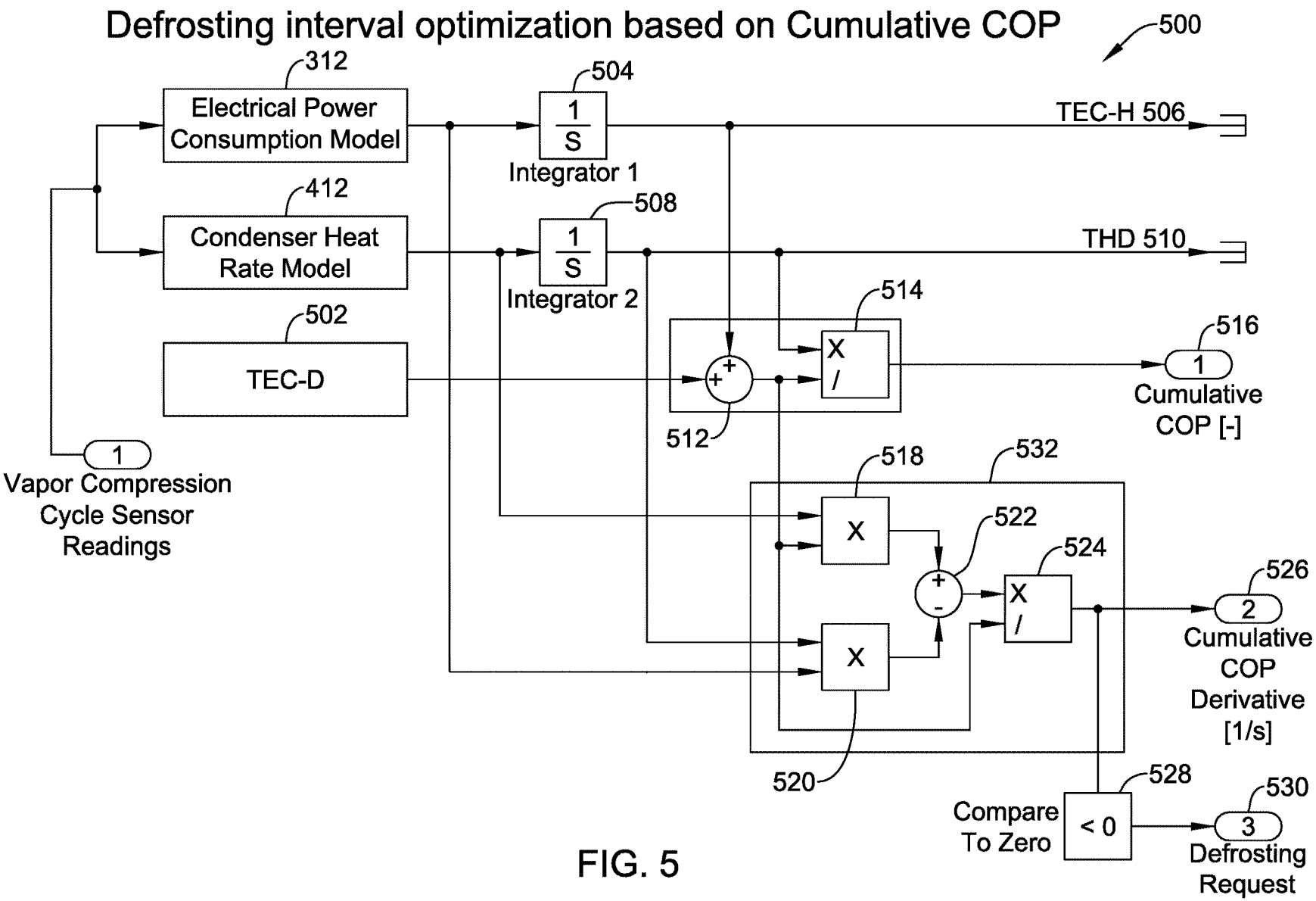
FIG. 5 is a flow chart showing an illustrative method for initializing a next defrosting cycle or period of the vapor compression system.

FIG. 5 is a flow chart showing an illustrative method 500 for initializing a next defrosting cycle or period for the vapor compression system 100. As shown in FIG. 5, the controller device 200/processor 202 may maintain/store a TEC-D 502 by the vapor compression system 100 during a previous defrosting cycle. In some examples, the TEC-D 502 may be an average of the TEC-D during a previous "N" defrosting cycles, wherein "N" is an integer greater than 1. In some examples, the TEC-D 502 may be obtained using a method similar to that shown in FIG. 3A, but during the previous defrost cycle rather than during an operational cycle. In this context, the defrost cycle is interposed between two operational cycles. In some cases, the TEC-D 502 may be provided as a fixed value by an installer/technician. At step 504, vapor compression system control application 218 may provide instructions to the processor 202 to integrate the electrical energy consumed 312 (see FIG. 3A) while the vapor compression system 100 is delivering heat during a current operational cycle following completion of a defrosting cycle, in order to determine and record a measure related to a total energy consumed by the compressor TEC-H 506 during the current operational cycle of the vapor compression system 100. Similarly, at step 508, vapor compression system control application 218 may provide instructions to the processor 202 to integrate the condenser heat rate 412 (see FIG. 4A) while the vapor compression system 100 is delivering heat during a current operational cycle following completion of a defrosting cycle, in order to determine and record a measure related to a total condenser heat provided by the compressor THD 510 during the current operational cycle of the vapor compression system 100. At step 512, the vapor compression system control application 218 may provide instructions to the processor 202 to obtain a sum of the TEC-H 506 and the TEC-D 502. At step 514, the vapor compression system control application 218 may provide instructions to the processor 202 to divide the THD 510 by the sum of the TEC-H 506 and the TEC-D 502 (i.e., CCOP=THD/(TEC-H+TEC-D)) to determine a current CCOP 516 of the vapor compression system 100.

Figure 6:
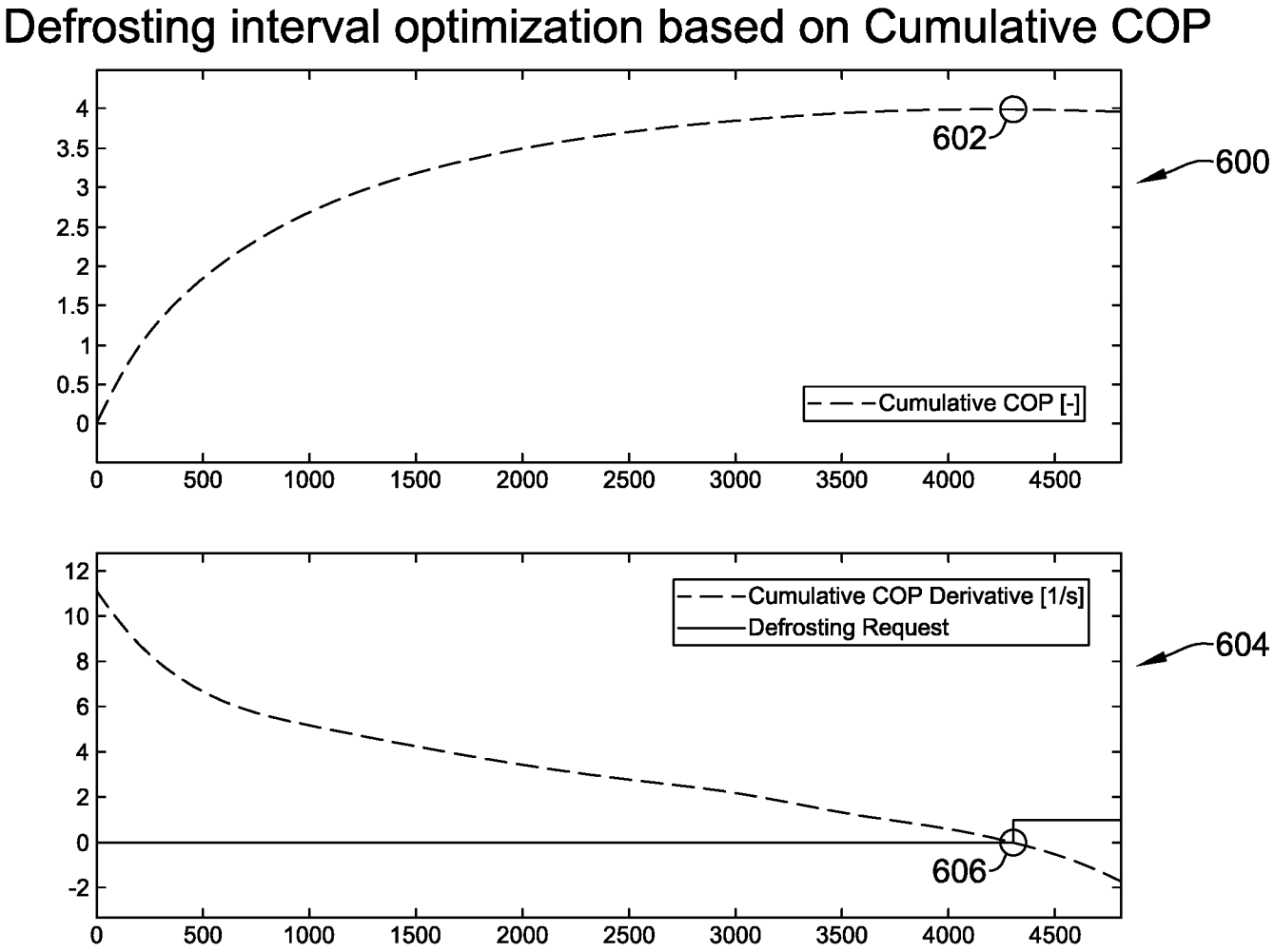
FIG. 6 is a graph depicting an example of a cumulative coefficient of performance (CCOP), a graph depicting an example of a derivative of the CCOP, and a resulting defrost request signal.

Turning briefly to FIG. 6, a top graph 600 depicts an example of the CCOP 516 during an operational cycle where the vapor compression system 100 is delivering heat. As shown in graph 600, the CCOP 516 starts at zero since the THD 510 is equal to zero when the operational cycles begins (following a defrost cycle). As time progresses, the THD 510 begins to increase, causing an increase in the CCOP 516, as shown by the rise in graph 600. However, the TEC-H 506 also increases as time progresses. As ice builds up on the evaporator 114, the evaporator becomes less efficient, and the TEC-H 506 increases at a faster rate than the THD 510, thus causing the slope of the CCOP 516 to decrease over time, eventually rolling over to a negative slope as shown in graph 600. The CCOP 516 reaches a maximum at point 602 when the slope (i.e. derivative) of the CCOP 516 curve equals zero.

Turning back to FIG. 5, block 532 may operate as a differentiator to calculate the derivative (i.e. slope) of the CCOP 516. At step 518, the vapor compression system control application 218 may provide instructions to the processor 202 to obtain a product of the condenser heat rate 412 and the sum of the TEC-H 506 and the TEC-D 502 (i.e., condenser heart rate×(TEC-H+TEC-D)). Similarly, the vapor compression system control application 218 may provide instructions to the processor 202 to obtain a product of the THD 510 and the electrical energy consumed 312 (i.e., THD×electrical energy consumed). At step 522, the vapor compression system control application 218 may provide instructions to the processor 202 to obtain a difference of (condenser heart rate×(TEC-H+TEC-D)) and (THD×electrical energy consumed) (i.e., condenser heart rate×(TEC-H+TEC-D)−(THD×electrical energy consumed)). At step 524, the vapor compression system control application 218 may provide instructions to the processor 202 to obtain a quotient of (condenser heart rate×(TEC-H+TEC-D)−(THD×electrical energy consumed)) and a square of the sum of the TEC-H 506 and the TEC-D 502 (i.e., (condenser heart rate×(TEC-H+TEC-D)−(THD×electrical energy consumed))/(TEC-H+TEC-D)−2) to obtain a derivative of the CCOP 526. Additionally, at step 528, the vapor compression system control application 218 may provide instructions to the processor 202 to compare the derivative (i.e. slope) of the CCOP 526 to zero. In some cases, if the derivative of the CCOP 526 is greater than zero, the vapor compression system 100 may continue to deliver heat during the operational period. However, if the derivative of the CCOP 526 is less than or equal to zero, it may be determined that the vapor compression system 100 is running at or has passed its most efficient state due to ice build-up (i.e., the CCOP 516 has reached or has passed its maximum value). Accordingly, at step 530, the vapor compression system control application 218 may provide instructions to the processor 202 to initiate the next defrosting cycle for the vapor compression system 100. upon receiving the initiation instructions, the vapor compression system 100 may begin the next defrost cycle to melt the accumulated ice build-up on the evaporator 114.

Turning again to FIG. 6, a bottom graph 604 depicts an example of the derivative of the CCOP 526 during an operational cycle where the vapor compression system 100 is delivering heat. As shown in graph 604, the derivative of the CCOP 526 is at a maximum when the incremental increase (i.e., slope) of the CCOP 516 is greatest. As discussed in regard to graph 600, as time progresses, the TEC-H 506 increases. The increasing TEC-H 506 causes the derivative of the CCOP 516 to decrease. As ice builds up on the evaporator 114, the evaporator becomes less efficient, and the TEC-H 506 increases at a faster rate than the THD 510, thus causing the slope of the CCOP 516 to decrease over time, eventually rolling over to a negative slope at point 602 as shown in graph 600. The CCOP 516 reaches a maximum at point 602 when the slope (i.e. derivative) of the CCOP 516 curve equals zero. The defrost request signal is shown at 606, which switches state from low to high when the derivative of the CCOP 516 crosses zero.

Although the present system and/or approach has been described with respect to at least one illustrative example, many variations and modifications will become apparent to those skilled in the art upon reading the specification. It is therefore the intention that the appended claims be interpreted as broadly as possible in view of the related art to include all such variations and modifications.

What is claimed is:

1. A method of operating a vapor compression system that has a compressor and an evaporator, wherein the vapor compression system is configured to produce heat during a heating cycle and defrost the evaporator of the vapor compression system during a defrosting cycle, the method comprising:

determining a measure related to a total heat delivered (THD) by the vapor compression system following a completion of a defrosting cycle;

determining a measure related to a total electrical energy consumed (TEC-H) by the vapor compression system while delivering heat following completion of the defrosting cycle;

maintaining a measure related to a total electrical energy consumed (TEC-D) by the vapor compression system during a previous defrosting cycle;

determining a cumulative coefficient of performance (CCOP) of the vapor compression system based at least in part on the measure related to a total heat delivered (THD) by the vapor compression system following the completion of a defrosting cycle, the measure related to a total electrical energy consumed (TEC-H) by the vapor compression system while delivering heat following the completion of the defrosting cycle, and the measure related to a total electrical energy consumed (TEC-D) by the vapor compression system during the defrosting cycle; and initiating a next defrosting cycle at a time that is based at least in part on one or more characteristics of the cumulative coefficient of performance (CCOP).

2. The method of claim 1, wherein the compressor and the evaporator circulate a refrigerant.

3. The method of claim 1, wherein determining the measure related to the total heat delivered (THD) by the vapor compression system following the completion of the defrosting cycle comprises:

determining a speed of the compressor;

sensing a discharge pressure of the refrigerant at an output of the compressor, and using the discharge pressure to identify a condensing temperature of the refrigerant;

sensing a suction pressure of the refrigerant at an input of the compressor, and using the suction pressure to identify an evaporating temperature of the refrigerant; and determining the measure related to the total heat delivered (THD) by the vapor compression system based at least in part on the speed of the compressor, the condensing temperature and the evaporating temperature.

4. The method of claim 3, further comprising sensing a discharge temperature of the refrigerant at the output the compressor, and wherein the measure related to the total heat delivered (THD) by the vapor compression system is based at least in part on the speed of the compressor, the condensing temperature, the evaporating temperature and the discharge temperature.

5. The method of claim 4, further comprising sensing the discharge pressure and the suction pressure using respective pressure sensors.

6. The method of claim 1, wherein the CCOP is determined by dividing the measure related to a total heat delivered (THD) by the sum of the measure related to the total electrical energy consumed (TEC-H) by the vapor compression system while delivering heat plus the measure related to the total electrical energy consumed (TEC-D) by the vapor compression system during the defrosting cycle.

7. The method of claim 6, wherein the measure related to the total electrical energy consumed (TEC-D) by the vapor compression system during the defrosting cycle is an average of the total electrical energy consumed (TEC-D) by the vapor compression system during a previous "N" of the defrosting cycle, wherein "N" is an integer greater than or equal to 1.

8. The method of claim 6, wherein the next defrosting cycle is initiated at a time when the cumulative coefficient of performance (CCOP) reaches a maximum value.

9. The method of claim 6, wherein the next defrosting cycle is initiated at a time when a derivative of the cumulative coefficient of performance (CCOP) crosses zero.

10. The method of claim 1, wherein the vapor compression system comprises a heat pump system configured to heat a building.

11. The method of claim 1, wherein the vapor compression system comprises a refrigeration system.

12. A vapor compression system comprising:

a compressor configured to pressurize a refrigerant;

a condenser operatively coupled to the compressor and configured to receive the compressed refrigerant from the compressor;

an evaporator operatively coupled to the compressor and configured to return expanded refrigerant to the compressor;

an expansion valve operatively coupled between the evaporator and the condenser and configured to expand the compressed refrigerant;

a controller operatively coupled to the compressor and configured to:

record a heat delivered by the refrigerant and an operational energy of the compressor during an operational period of the vapor compression system;

determine a cumulative coefficient of performance (CCOP) of the system based on the recorded delivered heat, the recorded operational energy, and a defrost energy consumed by the compressor during a previous defrost period of the vapor compression system; and initiate a next defrost period of the vapor compression system in response to the CCOP of the system meeting one or more predefined conditions.

13. The vapor compression system of claim 12, further comprising:

a set of sensors operatively coupled to the controller, the set of sensors configured to sense a discharge pressure of the refrigerant at an output of the compressor and a suction pressure of the refrigerant at an input of the compressor, wherein the discharge pressure is used to identify a condensing temperature of the refrigerant and the suction pressure is used to identify an evaporating temperature of the refrigerant.

14. The vapor compression system of claim 13, wherein the recorded heat delivered by the refrigerant and the operational energy of the compressor is based at least in part on the condensing temperature of the refrigerant, the evaporating temperature of the refrigerant, and a speed of the compressor.

15. The vapor compression system of claim 13, wherein the CCOP is determined by dividing the recorded delivered heat by the sum of the recorded operational energy plus the defrost energy consumed by the compressor during the previous defrost period of the vapor compression system.

16. The vapor compression system of claim 15, wherein the next defrost period is initiated at a time when the CCOP reaches a maximum value.

17. A non-transient computer readable medium comprising instructions stored thereon that when executed by a processor cause the processor to:

receive one or more sensed conditions of a vapor compression system;

using one or more of the sensed conditions to determine a measure related to a total heat delivered (THD) by the vapor compression system following a completion of a defrosting cycle;

using one or more of the sensed conditions to determine a measure related to a total electrical energy consumed (TEC-H) by the vapor compression system while delivering heat following the completion of the defrosting cycle;

store a measure related to a total electrical energy consumed (TEC-D) by the vapor compression system during a previous defrosting cycle;

determining a cumulative coefficient of performance (CCOP) of the vapor compression system based at least in part on the measure related to a total heat delivered (THD) by the vapor compression system following the completion of a defrosting cycle, the measure related to a total electrical energy consumed (TEC-H) by the vapor compression system while delivering heat following the completion of the defrosting cycle, and the measure related to a total electrical energy consumed (TEC-D) by the vapor compression system during the defrosting cycle; and initiating a next defrosting cycle of the vapor compression system at a time that is based at least in part on one or more characteristics of the cumulative coefficient of performance (CCOP).

18. The non-transient computer readable medium of claim 17, wherein the next defrosting cycle is initiated at a time when the cumulative coefficient of performance (CCOP) reaches a maximum value.

19. The non-transient computer readable medium of claim 17, wherein the vapor compression system includes a compressor and an evaporator circulating a refrigerant, and wherein determining the measure related to the total heat delivered (THD) by the vapor compression system following the completion of the defrosting cycle comprises:

determining a speed of the compressor;

sensing a discharge pressure of the refrigerant at an output of the compressor, and using the discharge pressure to identify a condensing temperature of the refrigerant;

sensing a suction pressure of the refrigerant at an input of the compressor, and using the suction pressure to identify an evaporating temperature of the refrigerant; and determining the measure related to the total heat delivered (THD) by the vapor compression system based at least in part on the speed of the compressor, the condensing temperature and the evaporating temperature.

20. The non-transient computer readable medium of claim 19, further comprising sensing a discharge temperature of the refrigerant at the output the compressor, and wherein the measure related to the total heat delivered (THD) by the vapor compression system is based at least in part on the speed of the compressor, the condensing temperature, the evaporating temperature and the discharge temperature.

* * * * *